US010220442B2

(12) United States Patent
Cai

(10) Patent No.: US 10,220,442 B2
(45) Date of Patent: Mar. 5, 2019

(54) FLUX-COATED BINDER FOR MAKING METAL-MATRIX COMPOSITES, A DRILL BODY AND DRILL BIT INCLUDING THE SAME, AND METHODS OF MANUFACTURE

(71) Applicant: Smith International Inc., Houston, TX (US)

(72) Inventor: Mingdong Cai, Houston, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 439 days.

(21) Appl. No.: 14/832,749

(22) Filed: Aug. 21, 2015

(65) Prior Publication Data

US 2016/0059311 A1 Mar. 3, 2016

Related U.S. Application Data

(60) Provisional application No. 62/043,125, filed on Aug. 28, 2014.

(51) Int. Cl.

| | |
|---|---|
| ***B22F 1/00*** | (2006.01) |
| ***B22F 1/02*** | (2006.01) |
| ***C22C 1/10*** | (2006.01) |
| *C22C 29/00* | (2006.01) |
| *C22C 29/06* | (2006.01) |
| *C22C 29/08* | (2006.01) |

(52) U.S. Cl.

CPC ..... *B22F 1/0059* (2013.01); *B22F 1/02* (2013.01); *C22C 1/1036* (2013.01); *C22C 1/1068* (2013.01); *C22C 29/005* (2013.01); *C22C 29/067* (2013.01); *C22C 29/08* (2013.01)

(58) Field of Classification Search

CPC ..... B22F 1/0059

See application file for complete search history.

(56) References Cited

U.S. PATENT DOCUMENTS

| | | | | |
|---|---|---|---|---|
| 3,175,932 | A * | 3/1965 | Brady | B23K 35/3606 148/23 |
| 4,682,987 | A * | 7/1987 | Brady | B24D 3/007 427/376.3 |
| 5,765,095 | A | 6/1998 | Flak et al. | |
| 6,244,497 | B1 * | 6/2001 | Conn | B23K 35/282 228/119 |
| 6,287,360 | B1 | 9/2001 | Kembaiyan et al. | |

(Continued)

FOREIGN PATENT DOCUMENTS

| | | |
|---|---|---|
| CN | 103361591 A | 10/2013 |
| JP | S60089503 A | 5/1985 |

(Continued)

OTHER PUBLICATIONS

Dow Chemical Company, Carbowax Industrial Brochure, Oct. 2011, Form No. 118-01789-1011 AMS;www.dow.com/polyglycols/polyethylene/products/carbowaxp.*

(Continued)

*Primary Examiner* — Colleen P Dunn
*Assistant Examiner* — Rajinder Bajwa

(57) ABSTRACT

A method of making a flux-coated binder includes treating metal binder slugs to have an adherent surface, adding a flux powder to the treated metal binder slugs, and distributing the flux powder on the adherent surface of the metal binder slugs.

19 Claims, 13 Drawing Sheets

(56) References Cited

U.S. PATENT DOCUMENTS

| | | | | |
|---|---|---|---|---|
| 7,784,381 | B2 | 8/2010 | Ladi et al. | |
| 7,810,588 | B2 | 10/2010 | McClain et al. | |
| 7,905,161 | B2 | 3/2011 | Butler et al. | |
| 7,963,348 | B2 | 6/2011 | Laird et al. | |
| 8,342,268 | B2 | 1/2013 | Lockstedt et al. | |
| 8,535,408 | B2 | 9/2013 | Sue et al. | |
| 2006/0090937 | A1 | 5/2006 | McDonough | |
| 2006/0231162 | A1 | 10/2006 | Swidersky et al. | |
| 2008/0100154 | A1* | 5/2008 | Imagawa | B22F 1/02 310/44 |
| 2010/0278604 | A1 | 11/2010 | Glass et al. | |
| 2013/0037172 | A1 | 2/2013 | Garcia-Juan et al. | |
| 2013/0330139 | A1 | 12/2013 | De Rynal | |

FOREIGN PATENT DOCUMENTS

| | | | |
|---|---|---|---|
| JP | H03199302 | A | 8/1991 |
| KR | 1020090084668 | A | 8/2009 |
| KR | 1020140002725 | A | 1/2014 |
| WO | 2011023394 | A1 | 3/2011 |
| WO | 2012016317 | A1 | 2/2012 |

OTHER PUBLICATIONS

Nocolock, Aluminum brazing news knowledge technology, Accessed Dec. 15, 2013; 5 pages.

International Search Report and Written Opinion issued in International Patent Application No. PCT/US2015/046500 dated Oct. 12, 2015, 11 pages.

International Preliminary Report on Patentability issued in International Patent Application No. PCT/US2015/046500 dated Feb. 28, 2017, 10 pages.

* cited by examiner

FLUX-COATED BINDER FOR MAKING METAL-MATRIX COMPOSITES, A DRILL BODY AND DRILL BIT INCLUDING THE SAME, AND METHODS OF MANUFACTURE

CROSS REFERENCE TO RELATED APPLICATION

This application claims priority to and the benefit of U.S. Provisional Application 62/043,125 filed on Aug. 28, 2014, the entirety of which is incorporated herein by reference.

BACKGROUND

The manufacturing of matrix drill bit bodies involves loading hard matrix particles and a binder metal into a mold and heating the resulting load assembly to melt the binder and facilitate infiltration of the binder metal into the hard matrix particles. Upon cooling, the infiltration process results in a metal-matrix composite that forms a bit body. Flux may be included in the assembly to reduce impurities that form during infiltration and that lead to defects in the resulting metal-matrix composite.

SUMMARY

Embodiments of the present disclosure are directed to a flux-coated binder and a method of manufacturing the same. Embodiments of the present disclosure are also directed toward a metal-matrix composite made using a flux-coated binder, a drill bit body including the metal-matrix composite, a drill bit including the drill bit body, and methods of manufacturing the same.

According to an embodiment, a method of making a flux-coated binder (e.g., for use in matrix-based drill bits) includes treating metal binder slugs to have an adherent surface; adding a flux powder to the treated metal slugs; and distributing the flux powder on the adherent surface of the metal binder slugs to provide a flux-coated binder.

In some embodiments, the treating the metal binder slugs includes adding and distributing a binding material. In some embodiments, the binding material is a fluid or a gel. In some embodiments, the binding material is a polyether polyol. In some embodiments, the fluid or gel includes a flux. In some embodiments, the fluid or gel includes a rosin or a modified rosin.

In some embodiments, the flux powder includes a boron-based compound. In some embodiments, the flux powder includes a boric acid and/or borate compound. In some embodiments, the flux powder includes fluorides.

In some embodiments, the treating the metal binder slugs to have an adherent surface includes heating the binder slugs to a temperature at which the flux powder adheres to the surface of the metal binder slugs. In some embodiments, the treating the metal binder slugs to have an adherent surface includes heating the metal binder slugs to a temperature at which the flux powder becomes adhesive. In some embodiments, the treating the metal binder slugs to have an adherent surface includes heating the metal binder slugs to a temperature at which the powder flux melts or partially melts.

In some embodiments, the adding the flux powder is performed while the metal binder slugs are adherent. In some embodiments, the distributing the flux powder is performed while the metal binder slugs including the flux powder are adherent. In some embodiments, the distributing the flux powder includes mechanically agitating the treated metal binder slugs including the flux powder. In some embodiments, the distributing the flux powder includes vibration shaking and/or tumbling the treated metal binder slugs including the flux powder.

In some embodiments, the binding material is a brown flux paste. In some embodiments, the binding material is selected from a liquid polyether polyol or a brown flux. In some embodiments, the liquid polyether polyol is Poly-G.

In some embodiments, the binder includes a metal selected from copper, aluminum, magnesium, iron-based, cobalt, or an alloy thereof. In some embodiments, the binder includes copper.

According to a further embodiment, a method of making a flux-coated binder (e.g., for use in matrix-based drill bits) includes: coating the metal binder slugs with a binding material to provide coated metal binder slugs; adding a flux powder to the coated metal binder slugs; and distributing the flux powder on the surface of the coated metal binder slugs to provide flux-coated metal binder slugs.

In some embodiments, the binding material is a fluid or a gel. In some embodiments, the binding material is a polyether polyol.

In some embodiments, the distributing the flux powder is performed by mechanically agitating the mixture including the flux powder. In some embodiments, the distributing the flux powder is performed by vibration shaking and/or tumbling the mixture including the flux powder.

According to another embodiment a method of making a flux-coated binder (e.g., for use in metal-matrix composite-based drill bits) includes: heating metal binder slugs to provide heated slugs; and dipping the heated slugs into a flux powder to coat the slugs with flux. In some embodiments, the heating the metal binder slugs is performed at a temperature below the melting temperature of the binder slugs.

According to a further embodiment, a method of making metal-matrix composite-based drill bits includes: loading a matrix powder into a bit body mold; loading a flux-coated binder into the mold to provide a load assembly; and heating the load assembly to allow for infiltration of the flux-coated binder into the matrix powder.

In some embodiments, the loading of the flux-coated binder includes: treating metal binder slugs to have an adherent surface; adding a flux powder to the treated metal binder slugs; distributing the flux powder on the surface of the metal binder slugs to provide a flux-coated binder; and loading the flux-coated binder into the mold.

In some embodiments, the treating the metal binder slugs includes adding and distributing a binding material. In some embodiments, the binding material is a fluid or a gel. In some embodiments, the binding material is a polyether polyol. In some embodiments, the fluid or gel includes a flux. In some embodiments, the fluid or gel includes a rosin or a modified rosin.

In some embodiments, the flux powder includes a boron-based compound. In some embodiments, the flux powder includes a boric acid and/or borate compound. In some embodiments, the treating the metal binder slugs includes heating the metal binder slugs to a temperature below the melting temperature of the metal binder slugs. In some embodiments, the adding the flux powder is performed while the metal based binder slugs are adherent.

In some embodiments, the distributing the flux powder is performed while the metal based binder slugs including the added flux powder are adherent. In some embodiments, the distributing the flux powder includes mechanically agitating the treated metal binder slugs including the added flux powder. In some embodiments, the distributing the added flux powder includes vibration shaking and/or tumbling the treated metal binder slugs including the flux powder. In some embodiments, the method further includes pre-heating the load assembly. In some embodiments, the pre-heating of the load assembly is performed at a temperature equal to or greater than the melting temperature of the flux. In some embodiments, heating of the load assembly is performed at a temperature greater than the melting temperature of binder.

According to another embodiment, a flux-coated binder (e.g., for making metal-matrix composite-based drill bits) includes: a binder including metal slugs; and a flux powder adhered to a surface of the metal slugs. In some embodiments, the flux powder adhered to the surface of the metal slugs is substantially uniformly distributed about the surface of the metal slugs. In some embodiments, the flux powder adhered to the surface of the metal slugs is uniformly distributed about the surface of the metal slugs. In some embodiments, the flux-coated binder further includes a binding material. In some embodiments, the binding material is coated directly on the binder between the binder and the flux powder to provide the binder with an adherent surface onto which the flux powder adheres.

In some embodiments, the binding material is a fluid or a gel. In some embodiments, the binding material is a polyether polyol. In some embodiments, the fluid or gel includes a flux. In some embodiments, the fluid or gel includes a rosin or a modified rosin. In some embodiments, the binding material is a brown flux paste. In some embodiments, the binding material is selected from a liquid polyether polyol or a brown flux. In some embodiments, the liquid polyether polyol is Poly-G.

In some embodiments, the flux powder includes a boron-based compound. In some embodiments, the flux powder includes a boric acid and/or borate compound. In some embodiments, the flux powder includes fluorides.

In some embodiments, the binder includes a metal selected from copper, aluminum, magnesium, iron-based, cobalt, or an alloy thereof. In some embodiments, the binder is copper-based metal slugs.

BRIEF DESCRIPTION OF THE DRAWINGS

These and other features of the present disclosure will be better understood with reference to the following detailed description when considered in conjunction with the accompanying drawings, which are briefly described below.

FIG. 6A (left) and FIG. 6A (right) are top-down views of binder heads after infiltration in a TRS mold using: a flux-coated binder (right); and a binder with a top-loaded flux powder (left). FIG. 6A serves as a comparison of defects on the surface of the respective binder heads.

FIGS. 6B and 6C serve as a comparison of defects throughout binder heads of FIG. 6A.

DETAILED DESCRIPTION

In manufacturing a drill bit body, a mixture of hard matrix particles (e.g., refractory metal carbides or nitrides, such as tungsten carbide (WC)) and a binder (e.g., a metal binder) may be placed in a drill bit body mold to form a load assembly. The load assembly is then heated to at least the melting temperature of the binder, thus forming a molten binder suitable to infiltrate the hard matrix particles. Infiltration of the molten binder into the hard matrix particles results in a binder-matrix composite (e.g., a metal-matrix composite) that forms a drill bit body.

Figure 1:
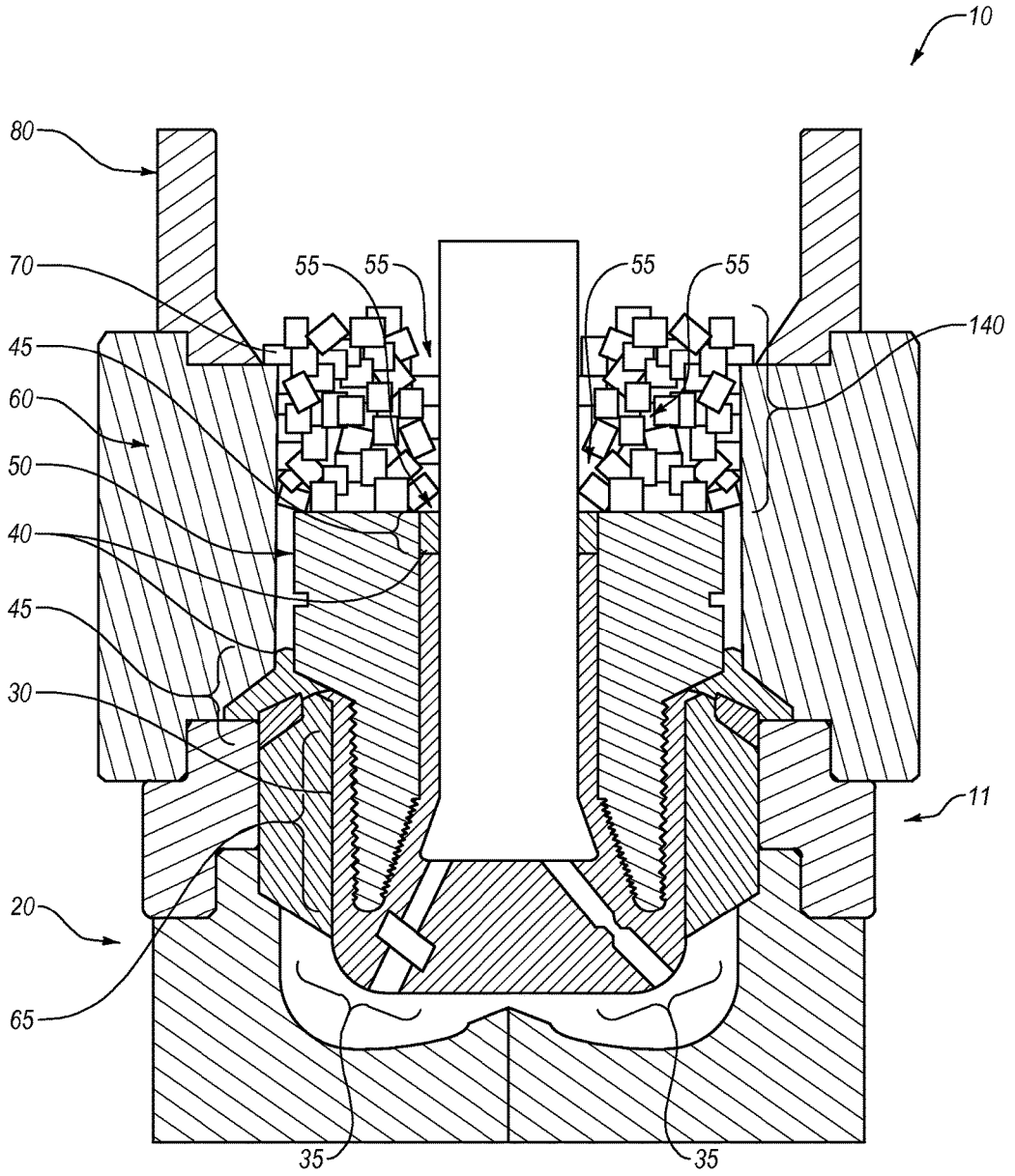
FIG. 1 is a schematic diagram showing an example of an assembly for making a metal matrix composite-based drill bit body.

By way of example, and referring to FIG. 1, a metal-matrix drill bit body may be fabricated by using a load assembly (10) including a mold (11) that includes a base (20), a first funnel ring (60), and a second funnel ring (80), each having a desired body shape and component configuration. Still referring to FIG. 1, a first matrix powder (30) is loaded into the base of the mold (20), which includes a blade region (35); a second matrix powder (40) is loaded into shoulder regions (45) of the mold by loading into a first funnel ring (60) fitted to the base of the mold; and a binder (70) is loaded into a binder region (140) by loading into a second funnel ring (80) fitted to the first funnel ring (60). The load assembly (10) may also include a blank (e.g., a steel blank) (50) as shown in FIG. 1, however, a blank may also be omitted. The load assembly (10) may be used to form a metal-matrix composite by heating the load assembly (10) to a temperature and time suitable to melt the binder (70)

(e.g., at 1400° F. or greater, or at about 1800° F. or greater for 0.75 to 2.5 hours) and facilitate infiltration of the molten binder into the matrix powders (30, 40). In addition to the heating to melt the binder, a pre-heating stage may be performed before the melting of the binder to reduce thermal shock within the load assembly and/or to reduce the presence of moisture in the load assembly. In some embodiments, the pre-heating stage is performed at a temperature of about 400° F. to about 1200° F. (e.g., about 200° C. to about 650° C.). In some embodiments, the pre-heating stage is performed at a temperature of about 600° F. to about 1000° F. (e.g., about 315° C. to about 540° C.). In FIG. 1, the binder is in the form of metal slugs (herein also referred to as "binder slugs" or "binder metal slugs").

In FIG. 1, a load assembly including two matrix powders is illustrated, each of which has been placed in the mold in a desired location (i.e., blade region (35) and shoulder region (45)). However, embodiments of the present disclosure are not limited thereto. For example, a single matrix powder may be used or more than two matrix powders may be used. Infiltration occurs when a molten binder flows through spaces between the hard matrix particles (e.g., by capillary action). Non-limiting examples of the hard matrix particles suitable for use in a metal-matrix composite according to some embodiments, includes refractory metal particles such as carbides and nitrides of tungsten (W), niobium (Nb), molybdenum (Mo), Tantalum (Ta), Rhenium (Rh), titanium (Ti), vanadium (V), rhodium (Rh), zirconium (Zr), hafnium (Hf), ruthenium (Ru), osmium (Os), and iridium (Ir). However, any suitable material that can be infiltrated with a binder material (e.g., a metal binder) as will be described in more detail below may be used.

Figure 2:
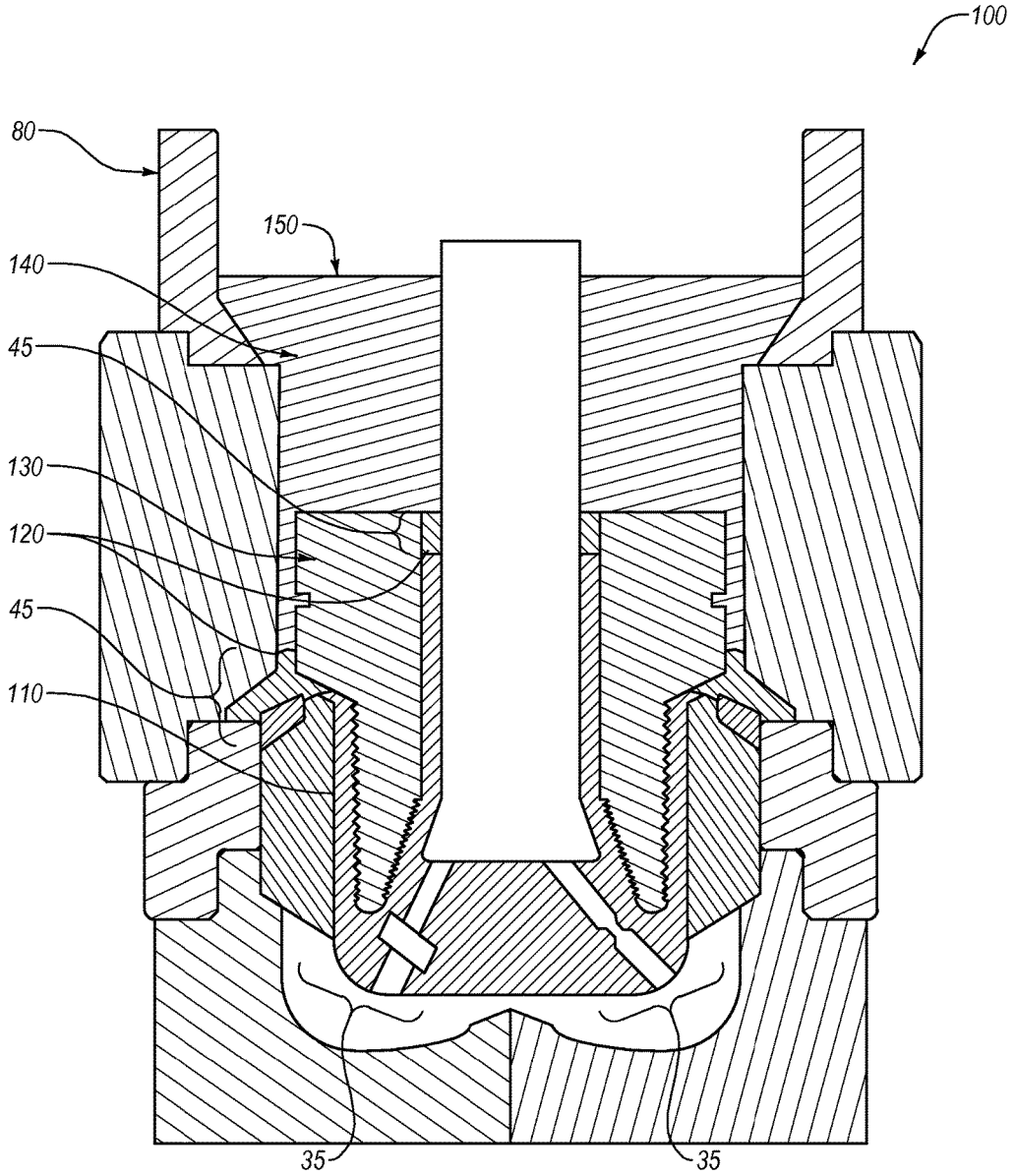
FIG. 2 is a schematic diagram showing an example of compositional regions of an in-mold metal-matrix composite resulting from infiltration using the assembly illustrated in FIG. 1.

Upon cooling, the hard matrix particles and the binder metal form a strong, hard, and durable metal-matrix composite with regions that vary in composition. For example, referring to FIG. 2, an in-mold bit body (100) (i.e., the load assembly after infiltration and subsequent cooling) has a first metal-matrix composite region (110) including a blade region (35), a second metal-matrix composite region (120) in shoulder regions (45) of the mold, a binder region (140), and a steel blank region (130). The upper portion of the binder region (140) is referred to as the binder head (150).

In the load assembly shown in FIG. 1, a flux powder may be used to purify the molten binder (e.g., by reacting with binder surface oxides to form slags) during melting and subsequent infiltration. In particular, the flux powder may be loaded on top of the binder (70). In order to adequately purify the molten binder, the flux may be distributed (e.g., uniformly distributed) throughout the molten binder during melting and subsequent infiltration.

Generally, a flux is a chemical cleaning agent, flowing agent and/or purifying agent that reacts with the binder to form oxides. Fluxes are generally mixtures of various components. Sample mineral flux components include borates, fused borax, elemental boron, fluoroborates, fluorides, chlorides, acids, alkalis, wetting agents, and/or water. Any suitable flux material may be used. Examples of suitable flux materials will be described in more detail below.

Generally, binders for use in binder matrix composites can be any suitable binder that infiltrates the hard material particles, such as a metal binder, e.g., a binder alloy. Suitable binders include copper alloys, brass alloys, and/or other non-ferrous alloys, such as alloys including copper, manganese, nickel, zinc, and/or tin or alloys including iron, nickel, silver, tin and/or cobalt. However, the binder used is not particularly limited and any suitable binder may be used.

In some embodiments, the quality of a metal-matrix composite formed using a load assembly such as the one in FIG. 1 may be related, at least in part, to the uniformity of flux distribution throughout the binder. A more uniform distribution allows more points of contact with the binder, which allows for improved purification of the molten binder and reduced defects due to the presence of regions lacking in flux and/or regions having too much flux. However, a top-loaded flux powder may slip through spaces (55) formed between binder slugs and too much flux may accumulate toward the bottom of the binder (70) and/or on the top layer of matrix powder (40) (e.g., during loading and/or transportation of the load assembly). The extra amount of flux on the matrix powder surface can lead to bondline defects (i.e., defects occurring at an interface between two compositional regions within the mold). Further, slags may form and may be trapped in the molten binder. Slags trapped in the molten binder may adversely affect the ability of the molten binder to uniformly and/or completely infiltrate the matrix particles. Excess flux and slags may cause porosities around the steel blank and/or part of the shoulder regions of the mold. An increased amount of binder can be used to help account for this effect. However, in doing so, a significant amount of the binder head (e.g., over half of the binder head) may have defects rendering the defective portion of the binder head unusable (and it may be necessary to machine off the defective portion of the binder head).

According to embodiments of the present disclosure, the flux-coated binder includes flux-coated metal binder slugs (herein also referred to as "flux-coated binder slugs" or "flux-coated binder"). In some embodiments, the flux-coated binder has a more uniform distribution of flux in a molten form, and thus may be used to form metal-matrix composites with reduced defects. Additionally, in some embodiments, less binder metal may be used in manufacturing a metal-matrix composite.

According to embodiments of the present disclosure, a flux-coated binder has a flux powder adhered to the surface of binder slugs. In some embodiments, the flux powder adhered to the surface of the metal slugs is substantially uniformly distributed about the surface of the metal slugs. That is, in some embodiments, the flux-coated binder has a substantially uniform surface-coating of flux powder. As used herein, the term "substantially" is used as a term of approximation, and not as a term of degree, and is intended to account for inherent, standard deviation in measured or calculated values, as would be understood by those of ordinary skill in the art.

Figure 3:
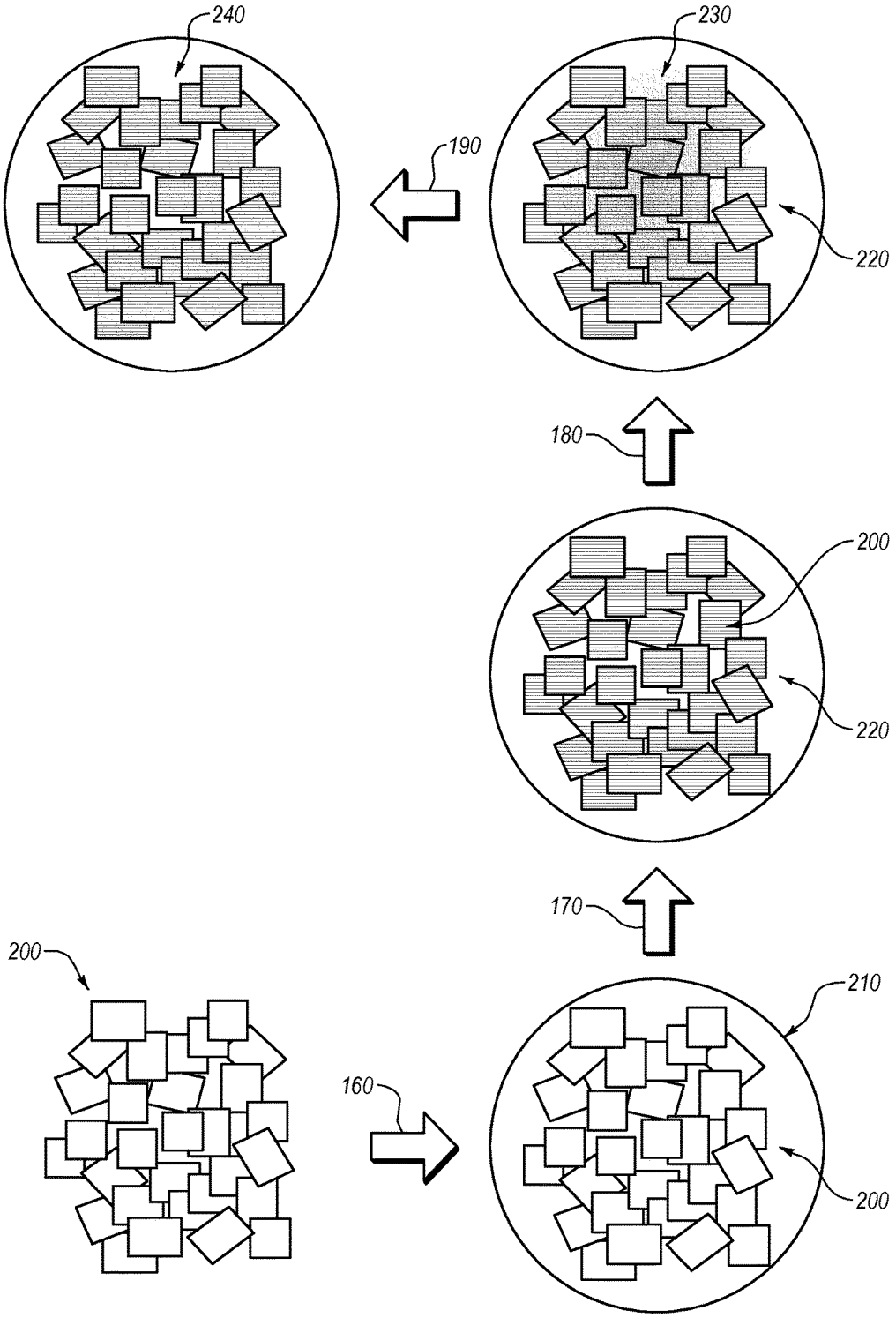
FIG. 3 is a schematic diagram showing a flux-coated binder and illustrating a method of making the flux-coated binder.

FIG. 3 shows, schematically, flux-coated binder slugs (240) (i.e., flux-coated binder) and illustrates a process of preparing the same. In FIG. 3, the process of preparing the flux-coated binder includes: placing binder slugs (200) (herein also referred to as "metal binder slugs" or "metal slugs") into a container (210) (160); treating the binder slugs (200) to provide binder slugs with an adherent surface (220) (170); adding a flux powder (230) to the treated binder slugs (220) (180); and distributing the flux powder on the surface of the binder slugs and adhering the flux powder to the adherent surface of the treated binder slugs, to provide a flux-coated binder (240) (190).

In some embodiments, the binder is in the form of metal slugs (e.g., copper-based slugs). The binder slugs may be spherical (or roughly spherical), cubic (or roughly cubic), irregularly shaped, or other various shapes. A particular kind of metal in the binder slugs (e.g., copper, iron) may be selected based on various factors, such as strength, melting temperature, cost, availability, a particular kind of powder to be infiltrated, and/or a particular kind of flux that may be desired. Non-limiting examples of the binder slugs include copper-based, aluminum-based, magnesium-based, iron-based, and cobalt-based alloys. In some embodiments, the binder slugs are roughly cubic and have dimensions of about 0.3" to about 0.7"× about 0.3" to about 0.7"× about 0.3" to about 0.7". For example, in some embodiments, the roughly cubic binder has dimensions of about 0.5"×0.5"×0.5". Analogous dimensions, in terms of a surface area to volume ratio may be extended to non-cubic binder particles.

According to embodiments, the binder slugs are substantially free of impurities/contaminants (e.g., grease, oil, and/or dust) before coating with the binder slugs with the binding material and the powder flux. In some embodiments, the binder may be cleaned and dried with an organic solvent to remove impurities/contaminates that may be present. Any suitable organic solvent may be used to clean the binder slugs. Suitable organic solvents include solvents that dissolve the impurities/contaminates on the binder without substantially reacting with and/or dissolving the binder slugs and that may be easily evaporated or removed such that the binder may be easily dried and substantially free of the solvent after cleaning. Non-limiting examples of suitable organic solvents include acetone, methanol, ethanol, isopropanol, diethyl ether, benzene, dichloromethane, or the like.

In some embodiments, about 50 lbs. or less of the binder is placed in the container (e.g., a clean container). However, embodiments of the present disclosure are not limited thereto. The amount of binder placed in the container may depend on the capacity of the container, ease of loading, unloading, and handling, or the like.

In some embodiments, heating the binder to a medium-high temperature provides the binder with an adherent surface. As used herein, the term "adherent surface" refers to a surface that is capable of having a material adhere thereto. That is, the adherent surface may include an adhesive-coated surface or may include a surface that is capable of adhering to an adhesive material (e.g., a melted flux).

The medium-high temperature includes any temperature suitable to allow flux to adhere to the surface of the binder. For example, the medium-high temperature may be a temperature that is close to the melting point of the flux such that the flux may begin to melt and become adhesive when in contact with the heated binder. In some embodiments, the binder is heated to a temperature suitable to melt (or partially melt) the flux upon contact with the heated binder. In these embodiments, the heated binder is adherent, in that the heated binder is capable of having the flux adhere its surface. The flux may be added to the heated binder or the heated binder may be added to the flux.

In either of the above described embodiments, the heated binder/flux mixture may be mechanically agitated to distribute the flux. The agitation may be done before or after the heating. The mechanical agitation may include, for example, vibration shaking and/or tumbling. In some embodiments, the mechanical agitation may be performed for about 30 to about 120 seconds.

In some embodiments, the flux may include a mixture of two or more flux powders such that a wider working temperature range of the flux may be obtained (i.e., temperatures at which the flux is capable of reacting with surface oxides in the molten binder).

In some embodiments, a binding material is used to provide the binder with the adherent surface. The binding material may be in the form of a fluid, gel, or paste. According to embodiments, the binding material includes any suitable fluid gel, or paste that adheres to the surface of the binder slugs and allows the flux powder to be coated onto the binder (e.g., any suitable adhesive). Additionally, according to some embodiments, suitable binding materials include materials that do not react with (or substantially do not react with) the binder or flux at various temperatures (e.g., at a storage temperatures and/or pre-heating temperatures of the load assembly.). In some embodiments, the binding material is a material that is capable of evaporating or decomposing and evaporating during the-preheating stage so that the binding material does not contaminate the binder melt. For example, the binding material may be a viscous solvent, such as a polymeric solvent. Non-limiting examples of the viscous solvent include polyether polyols, such as polyether diols, polyether triols, and/or polyether tetraols); glycerol; ethylene glycol, dimethylsulfoxide; dimethylformamide; dimethylacetamide, polydimethyl siloxane, polypropylene glycol dimethylether, or a combination and/or derivative thereof. In some embodiments, the binding material is Poly-G (available from Monument Chemical Kentucky LLC, Kentucky USA).

In some embodiments, the binding material includes a flux, such as a rosin, a modified rosin, a borate, a fluoride, and/or boron. In some embodiments, the binding material includes brown flux. Brown flux, which is a gel, may be more suitable (e.g., in terms of viscosity) in the form of a paste, and thus may be diluted with a solvent, such as water and/or a polyether polyol (e.g., Poly-G) prior to being used as the binding material. The amount of added solvent may be any amount that provides a viscosity that is high enough to coat/adhere to the binding material and low enough to be substantially evenly distributed onto the binder surface with mechanical agitation. In some embodiments, the solvent is selected in accordance with a desired melting temperature of the brown flux or other flux paste. For example, a water-based brown flux may have a lower melting temperature than a Poly-G based brown flux. In some embodiments, a higher melting flux paste may be desired to reduce premature infiltration of the flux (i.e., the flux paste and the flux powder coated thereon) into the matrix powder. As another example, a lower melting flux paste may be suitable as a binding material for use on a binder with a lower melting temperature.

In some embodiments, the flux included in the binding material may further improve the properties of the flux-coated binder. For example, by using brown flux as the binding material together with the flux powder (described in more detail below) such as H-600 (class FB3-J according to AWS standards (2012)), the combination may provide a wider range of working temperature ranges of the flux (i.e., temperatures at which the flux is capable of reacting with surface oxides in the molten binder) and thus improved purity of the molten binder. Additionally, by including flux components with different melting temperatures or ranges, lower viscosity/lower melting components of the flux (i.e., components of the flux powder and/or of the binding material) may help bind and distribute higher viscosity/higher melting components of the flux during pre-heating and during infiltration.

The binding material may be added to the binder slugs by any suitable method. For example, sufficiently low viscosity fluids such as Poly-G may be sprayed onto the binder, while higher viscosity fluids or gels such as brown flux may be weighed into the container. According to embodiments, the amount of binding material used is an amount suitable to wet the binder slugs. For example, if the binding material is sprayed onto the binder slugs, a suitable amount of binding material may be an amount that wets the binder slugs, while leaving little to no binder material drops on the container (e.g., based on a visual inspection).

In some embodiments, after adding the binding material to the binder, the binder and the added binding material are mixed (e.g., by mechanically agitating the container) to distribute the binding material on the surface of the binder, thus providing the coated binder. In some embodiments, the mechanical agitation is performed by shaking (e.g., by using a compressed air driven shaker or tumbler) for an amount of time suitable to distribute or uniformly distribute the binding material on the binder surface. In some embodiments, the amount of time is about 15 seconds to 3 minutes, for example 30 to 120 seconds. However, embodiments of the present disclosure are not limited thereto. The amount of time may vary with the amount of binder slugs, the amount of binding material, and/or the amount of flux to be used; the type of binder (e.g., a copper-based binder); the type of binding material (e.g., Poly-G or brown flux paste); the type of flux to be used (e.g., a borate-containing flux such as H-600); an average size of binder slugs and/or an average size of flux particles to be used; and/or the amount of surface area by weight of the binder slugs. For example, the amount of time may increase with an increasing amount of binder slugs, an increasing viscosity of the binding material, and an increasing amount of surface area by weight of the binder slugs. Likewise, the amount of time may decrease with a decreasing amount of binding material, decreasing viscosity of the binding material; and a decreasing amount of surface area by weight of the binder slugs. In some embodiments, the longer the mixing time, the more evenly the binding material will be distributed on the surface of the binder.

In some embodiments, after distributing the binding material on the surface of the binder slugs, the flux powder may be weighed and added directly to the coated binder (i.e., the binder coated with/distributed on the binding material). In some embodiments, the amount of flux powder added to the coated binder is about 0.25 to about 2.5 wt % with respect to the total amount of binder in the container (e.g., about 0.5 wt %). The container including the coated binder slugs and the flux powder may be mechanically agitated in the same way as already described above with respect to the binding material, to distribute the flux powder onto the surface of the coated binder slugs, and adhere the powder flux to the surface of the coated binder slugs to form the flux-coated binder. The container may be mechanically agitated for an amount of time suitable to distribute the flux powder onto the surface of the binder slugs. In some embodiments, the amount of time to distribute the flux powder is any amount of time suitable to provide an approximately uniform coating of the flux powder on the surface of the coated binder slugs. In some embodiments, the amount of time is from about 15 to about 60 seconds (e.g., about 30 seconds). However, embodiments of the present disclosure are not limited thereto. The amount of time may vary with similar considerations as already described with respect to coating the binding material on the binder slugs.

According to embodiments, a suitable flux powder (e.g., a boron-based flux or a particular boron-based composition) may be selected based on the working temperature range of the flux and/or the melting temperature of the binder metal. For example, in some embodiments, the working temperature may include temperatures less than the melting temperature of the binder metal. In some embodiments, the working temperature may include temperatures greater than the melting temperature of the binder metal. In some embodiments, the working temperature of the flux may include the melting temperature of the binder. Non-limiting examples of suitable flux materials are shown in the following Tables 1 and 2.

TABLE 1

| Class | Form | Filler materials | Ingredients | Activity Range (° F.) |
|---|---|---|---|---|
| FB3-A | Paste | BAg and BCuP | Borates; fluorides | 1050-1600 |
| FB3-C | Paste | BAg and BCuP | Borates; Fluorides; Boron | 1050-1700 |
| FB3-D | Paste | BAg, BCu, BNi, BAu, and RBCuZn | Borates; Fluorides | 1400-2200 |
| FB3-F | Powder | BAg and BCuP | Borates; Fluorides | 1200-1600 |
| FB3-G | Slurry | BAg and BCuP | Borates; Fluorides | 1050-1600 |
| FB3-H | Slurry | BAg and BCuP | Borates; Fluorides; Boron | 1050-1700 |
| FB3-I | Slurry | BAg, BCu, BNi, BAu, and RBCuZn | Borates; Fluorides | 1400-2200 |
| FB3-J | Powder | BAg, BCu, BNi, BAu, and RBCuZn | Borates; Fluorides | 1400-2200 |
| FB3-K | Liquid | BAg, BCuP and RBCuZn | Borates | 1400-2200 |

TABLE 2

| Name | Form | Working temp (° F.) |
|---|---|---|
| Peterson No. 1 Blue flux[1] (class BF3-F) | powder | 1200-1600 |
| Peterson No. 2 High heat flux[1] (class FB3-J) | powder | 1400-2200 |
| AMCO 5009[1] (class FB3-J) | Powder | 1700-2500 |
| Handy Flux B-1[2] (class FB3-C) | Paste | 1100-1700 |
| J W Harris (H-600 flux)[3] (class FB3-J) | Powder | 1400-2200 |

[1]Available from Force Industries Division, American Solder & Flux Co., Inc. (Paoli, PA).
[2]Available from Lucas-Milhaupt, Inc. (Cudahy, WI).
[3]Available from The Harris Products Group (Mason, Ohio) (described herein as H-600 flux for clarity, but named "600 Flux").

Some flux materials described herein may be referred to herein by their class and/or their trade name and/or an accompanying manufacturer. The flux materials referred to by class are classified in accordance with the American Welding Society (AWS) standards (2012) for brazing fluxes and braze welding fluxes (See e.g., http://www.ansi.org/). The AWS standards provide the requirements for each class of flux. As such, the fluxes referred to herein by class may be purchased from any manufacturer.

According to embodiments of the present disclosure, the selection of flux powder and its application to the binder allows for reduced flux trapping at the interface of binder and a matrix powder, increased uniformity of the distribution of flux in the binder during melting, increased working area, and improved fluidity of the molten binder.

According to embodiments of the present disclosure, a metal-matrix composite may be manufactured by placing matrix particles into a mold; placing a flux-coated binder on top of the matrix particles; heating the resulting assembly to a temperature suitable to melt the binder and for a time to allow the binder to infiltrate the matrix particles; cooling the assembly after infiltration; and removing the metal-matrix composite from the mold. In some embodiments, the metal-matrix composite manufactured using the flux-coated binder may have reduced defects.

According to further embodiments of the present disclosure, a method of making a metal-matrix composite-based drill bit body includes loading a matrix powder into a drill bit body mold; loading a flux-coated binder into the mold to provide a load assembly; and heating the load assembly to allow for infiltration of the flux-coated binder into the matrix powder. Non-limiting examples of the load assembly include those already described above with reference to FIGS. 1, 10, and 11. In some embodiments, the loading of the flux-coated binder includes treating metal binder slugs to have an adherent surface; adding a flux powder to the treated metal binder slugs; distributing the flux powder on the surface of the metal binder slugs to provide a flux-coated binder; and loading the flux-coated binder into the mold. The flux-coated binder is the same as already described above. The metal binder slugs and the treating of the metal binder slugs are the same as already described above with respect to the flux-coated binder and the method of making the same. The flux powder and the adding and distributing of the flux powder are also the same as already described above with respect to the flux-coated binder and the method of making the same. In some embodiments, the method of making the metal-matrix composite-based drill bit body further includes fabricating a mold having a desired body shape and component configuration.

In some embodiments, the drill bit body made using the flux-coated binder may be manufactured more efficiently (e.g., by using less binder). For example, a minimum amount of binder that is theoretically required for complete infiltration of the matrix powder particles may be estimated. That is, the amount of binder required to fill the spaces between matrix powder particles may be estimated. The minimum amount of binder that is theoretically required for complete infiltration is based various features, such as the particular matrix powder particles (e.g., in terms of size, secondary structure, and composition) and a resulting volume fraction of the respective matrix powder particles after being compacted in the load assembly. This volume fraction is a function of matrix powder particle size and distribution. With this volume fraction, the minimum amount of binder may be calculated. The minimum amount of binder may vary among load assemblies. For example, the minimum amount of binder may vary with the size of the load assembly, the size, secondary structure, and composition of the matrix powders particles, the relative amounts of each different type of matrix powder, and/or how compacted the matrix powder particles are in the load assembly.

While the minimum amount of binder may be calculated for various load assemblies, the amount of binder is typically used in excess of this amount to help reduce or prevent defects in the drill bit body (e.g., by confining these defects to the binder head, which may subsequently (i.e., after infiltration and solidification) be machined off). In some embodiments, by using a flux-coated binder for infiltration, about 10% to about 40% (e.g., 30%) of excess binder may be used (and, e.g., about 20% to about 40% (e.g., about 30%) of the binder head may be machined off due to the formation of surface oxide after production and slags after infiltration and solidification). In conventional assemblies using a top-loaded flux powder, an excess of about 50% to about 70% of the binder may be used so that any imperfections may be confined to the binder head.

According to further embodiments of the present disclosure, a method of making a metal-matrix composite-based drill bit includes loading one or more of a matrix powder into the mold in desired locations (e.g., the shoulder, the body, or the blades); adding a flux-coated binder to the top of the mold (e.g., on top of the matrix powder); heating the resulting mold assembly to allow for infiltration of the binder into the hard matrix particles; cooling the resulting metal matrix-composite to provide an in-mold drill bit body; removing the drill bit body from the mold to provide an out-of-mold drill bit body; machining the drill bit body; fitting and welding the drill bit body to an API connector; and adding cutting elements (e.g., polycrystalline diamond compact (PDC) cutting elements) to the drill bit body.

Figure 15:
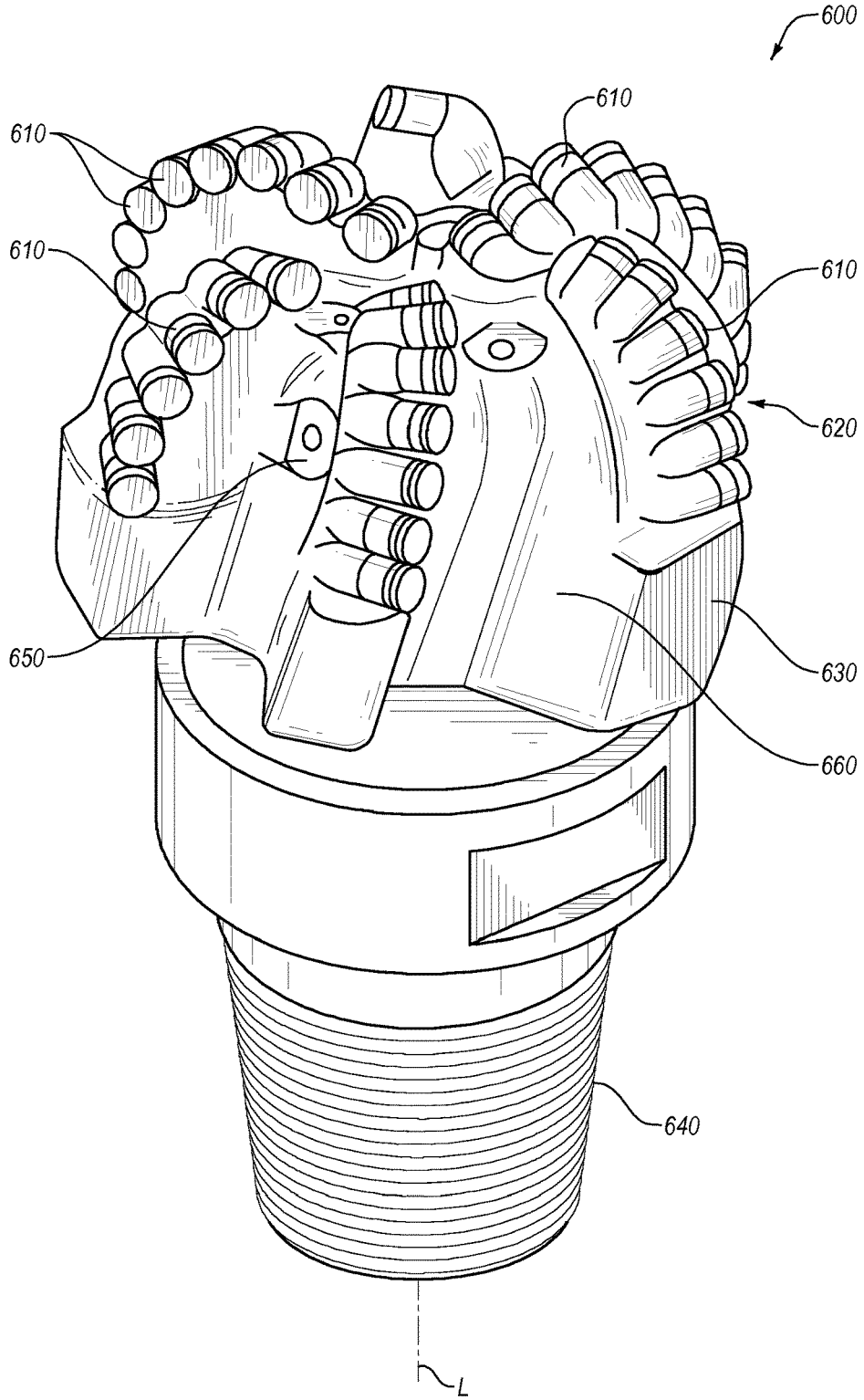
FIG. 15 is a schematic drawing showing an example of a drill bit.

An example of drill bit is shown schematically in FIG. 15. In particular, FIG. 15 shows an example of a polycrystalline diamond (PDC) drill bit. In this example, the drill bit (600) has a plurality of cutters with hard working surfaces. The drill bit (600) includes a drill bit body (660) having a threaded upper pin end (640) and a cutting end (620). The cutting end (620) may include a plurality of ribs or blades (630) arranged about a rotational axis (L) (also referred to as the longitudinal or central axis) of the drill bit and extending radially outward from the drill bit body (660). Cutting elements, or cutters, (610) are embedded in the blades (630) at set angular and radial locations relative to a working surface and with a desired back rake angle and side rake angle against a formation to be drilled.

Still referring to FIG. 15, a plurality of orifices (650) are positioned on the bit body 660 in areas between the blades (630). The orifices (650) may be referred to as "gaps" or "fluid courses." The orifices (650) may be adapted to accept nozzles. The orifices (650) may allow drilling fluid to be discharged through the drill bit in selected directions and at selected rates of flow between the blades (630) for lubricating and cooling the drill bit (600), the blades (630), and the cutters (610). The drilling fluid may also clean and remove cuttings as the drill bit (600) rotates and penetrates the formation to be drilled. The fluid courses may be positioned to provide additional flow channels for drilling fluid and to provide a passage for formation cuttings to travel past the drill bit (600) toward the surface of a wellbore.

Methods of making metal-matrix drill bit bodies and drill bits are also described, for example, in U.S. Pat. No. 8,342,268 and U.S. Pat. No. 6,287,360, both of which are incorporated herein by reference in their entirety. U.S. Pat. No. 8,342,268 and U.S. Pat. No. 6,287,360 are attached hereto as Appendices A and B, respectively, both of which form a part of the present specification.

EXAMPLES

The following Examples are presented for illustrative purposes only and do not limit the scope of the disclosure.

In each of Examples 1 to 3, copper-based metal slugs were used as the binder. The binder was checked for contaminants such as grease, oil, and the like. If containments were present, the binder was cleaned with acetone and dried.

Example 1: Preparing a Flux-Coated Binder

Figure 4A:
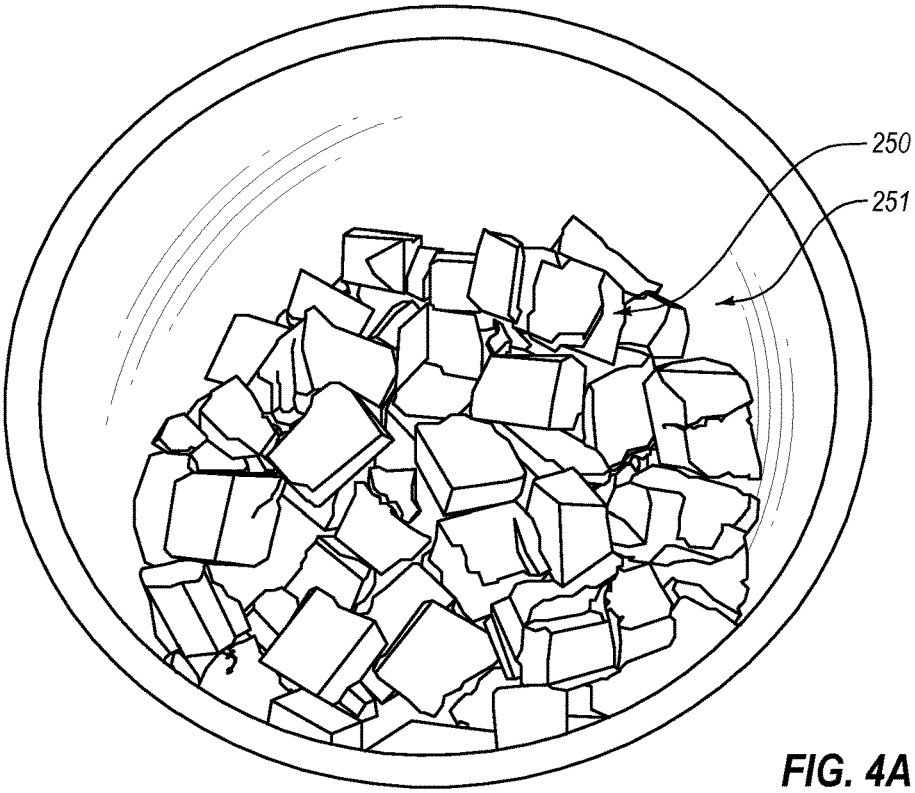
FIG. 4A shows an example of copper-based alloy binder in the form of metal slugs, placed in a clean plastic container to be used as a binder to make a metal-matrix composite by infiltration.
Figure 4B:
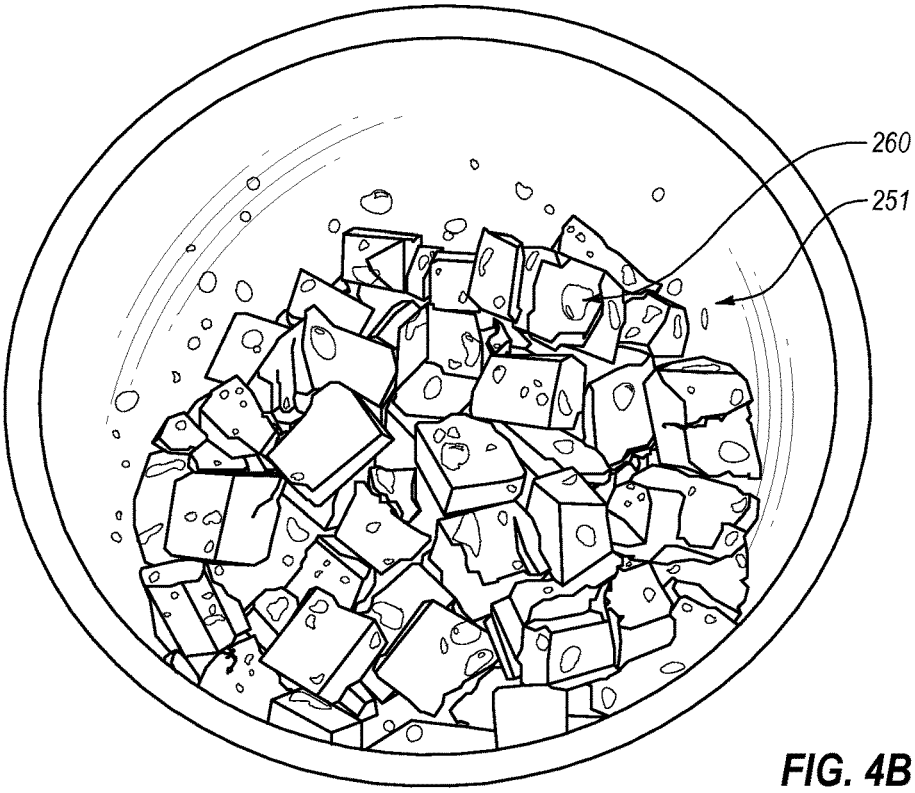
FIG. 4B shows the binder of FIG. 4A after being coated with a binding material.
Figure 5A:
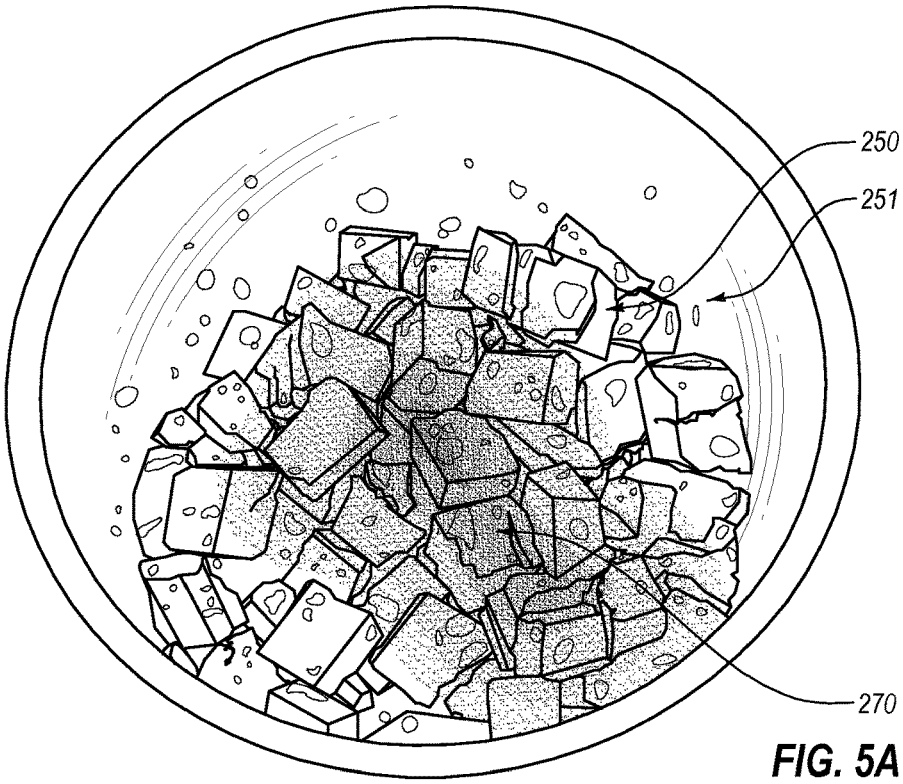
FIG. 5A shows the coated binder of FIG. 4B and an added flux powder.
Figure 5B:
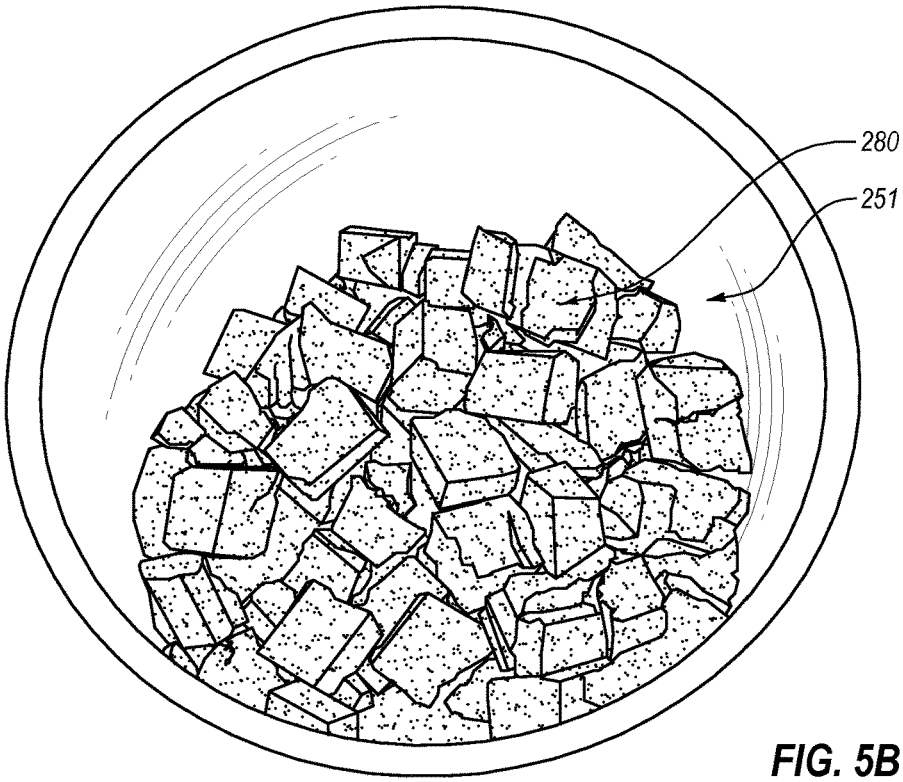
FIG. 5B shows a flux-coated binder prepared by mixing the coated binder and the added flux powder of FIG. 5A in order to distribute the flux powder about the surface of the binder.

As shown in FIGS. 4A to 4B, about 5.0 lbs. of a binder (a Cu—Mn—Ni—Zn—Sn based alloy having a melting point of about 900° C. to about 930° C. (e.g., about 1650° F. to about 1710° F.)) (250) was weighed out and placed into a clean plastic bottle (251). Poly-G was used as the binding material and was sprayed into the container, providing a wetted binder (260). The amount of Poly-G was enough to wet the binder without having a substantial amount of Poly-G drops on the bottle, based on a visual inspection. In particular, the amount of Poly-G was about 0.01 lbs. The bottle was then placed in a compressed air driven shaker for about 60 seconds. Based on the total weight of the binder, about 0.5 wt % of H-600 flux (270) was weighed out and added to the plastic bottle (251, FIG. 5A). In this Example, about 11.4 grams of H-600 flux was used for 5 lbs. of binder. The plastic bottle was then sealed and tumbled for 15 to 30 seconds to obtain a substantially uniform coating of flux on the surface of the binder. The resulting flux-coated binder (280, FIG. 5B) was transferred into a clean can and sealed for production.

Example 2: Preparing a Flux-Coated Binder

About 5.0 lbs. of a binder was weighed out and placed into a clean plastic bottle. About 0.3 to about 0.6 wt % of brown flux (based on the weight of the binder) was added into the bottle and the bottle was placed in a compressed air driven shaker for about 60 seconds. Based on the total weight of the binder, about 0.5 wt % of H-600 flux was weighed out and added to the plastic bottle. In this Example, about 11.4 grams of H-600 flux was used for 5 lbs. of binder. The plastic bottle was then sealed and tumbled for about 30 seconds to obtain a substantially uniform coating of flux on the surface of the binder. The resulting flux-coated binder was transferred into a clean can and sealed for production.

Example 3: Preparing a Flux-Coated Binder

About 5.0 lbs. of a binder was weighed out and placed into a clean container. Based on the total weight of the binder, 1-5 wt % of H-600 flux was weighed out. In this Example, about 100 grams of H-600 flux was used for the 5 lbs. of binder. The binder was heated to a temperature of about 425° C. (e.g., about 800° F.) for about 15 minutes in an induction heating furnace. The flux was then added to the container and the container was sealed and tumbled for about 30 seconds to produce a substantially uniform coating of flux on the surface of the binder. The resulting flux-coated binder was transferred into a clean can and sealed for production.

Figure 7:
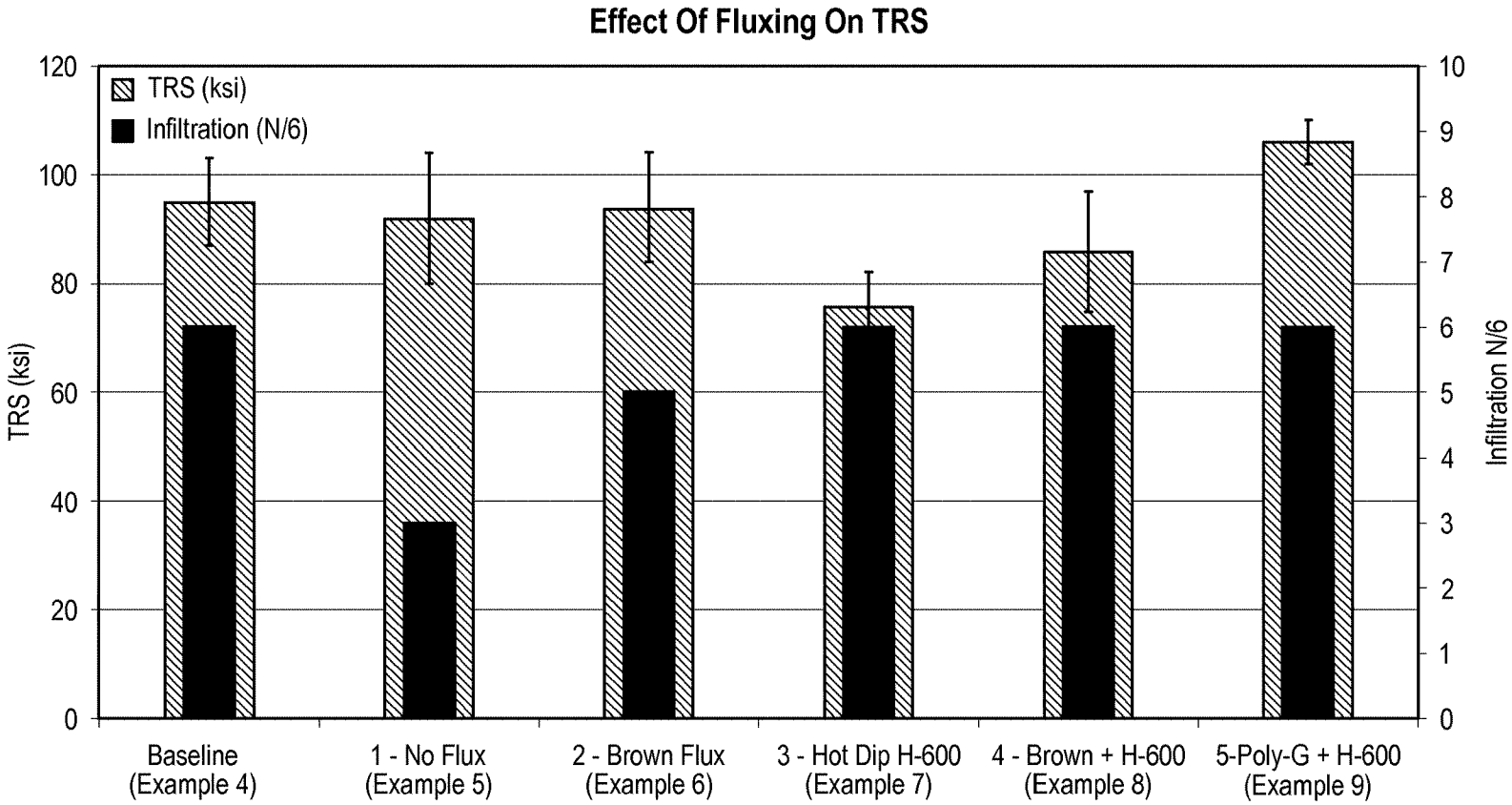
FIG. 7 shows a graph comparing five different metal-matrix composites prepared according to Examples 4 to 9.

Examples 4 to 9: Preparation and Comparison of TRS Test Coupon Manufactured Using Flux-Coated Binders and Non-Flux-Coated Binders Five sets of TRS (transverse rupture strength) test coupons (4.0×ϕ0.5") were prepared by infiltration of a tungsten carbide matrix powder with a binder. About 2.0 lbs. of binder slugs (a Cu—Mn—Ni—Zn—Sn alloy based having a melting point of about 790° C. to about 830° C. (e.g., about 1450° F. to about 1530° F.)) were used as the binder. The matrix powder used was an agglomerate tungsten carbide and cast tungsten carbide particles having a size of about 30 to about 200 micrometers and including about 2 wt % of an iron powder and about 2 wt % of a nickel powder. TRS coupons (Examples 4 to 9) were prepared according to the conditions specified in the following Table 3. A comparison of infiltration and TRS test results of Examples 4 to 9 is summarized in Table 3 and shown in FIG. 7. In particular, the graph in FIG. 7 shows a comparison of infiltration versus TRS for each test manufactured using the flux compositions applied as described above in Table 3.

TABLE 3

| Name | Flux | Pre-heat Temp. (° F.) | Furnace Temp. (° F.) | Infil-tration result** | TRS (ksi) |
|---|---|---|---|---|---|
| Example 4 (Baseline) | 0.02 lbs. H-600 flux powder | 1000 | 1800 | 6/6 | 95 ± 8 |
| Example 5 (No Flux) | No flux | 1000 | 1800 | 3/6 | 92 ± 12 |
| Example 6 (Brown Flux) | 0.02 lbs. Brown flux paste | 1000 | 1800 | 5/6 | 94 ± 10 |
| Example 7 (Hot Dip) | Hot dip H-600 flux powder | 1000 | 1800 | 6/6 | 76 ± 6 |
| Example 8 (Brown Flux and Flux Powder) | 0.02 lbs. brown flux paste and 0.02 lbs H-600 flux powder | 1000 | 1800 | 6/6 | 86 ± 11 |
| Example 9 (Poly-G and Flux Powder) | 0.01 lbs. Poly-G and 0.02 lbs H-600 flux powder | 1000 | 1800 | 6/6 | 106 ± 4 |

**The infiltration result is reported as N/6, where N refers to the number of samples fully infiltrated out of a total of 6.

Example 10: Preparation of a Metal-Matrix Composite Using Binder Slugs

Matrix particles (an agglomerate of tungsten carbide and cast tungsten carbide particles having a size of about 30 to about 200 micrometers and including about 2 wt % of an iron powder and about 2 wt % of a nickel powder) were loaded into a TRS mold having pin sizes of about 4" long with a diameter of about 0.5". Binder slugs (a Cu—Mn—Ni—Zn—Sn alloy based having a melting point of about 790° C. to about 830° C. (e.g., about 1450° F. to about 1530° F.)) were then added to the mold followed by about 0.2 wt % of H-600 flux. The resulting load assembly was then heated to 1800° F. for about 2 hours and then cooled to room temperature to form a metal-matrix composite.

Example 11: Preparation of a Metal-Matrix Composite Using Flux Coated Binder Slugs Matrix particles were loaded into a TRS mold. Flux-coated binder slugs were then added to the mold. The flux-coated binder slugs were prepared in accordance with Example 1. The resulting load assembly was then heated to about 1800° F. for about 2 hours and then cooled to room temperature to form a metal-matrix composite.

Figure 6B:
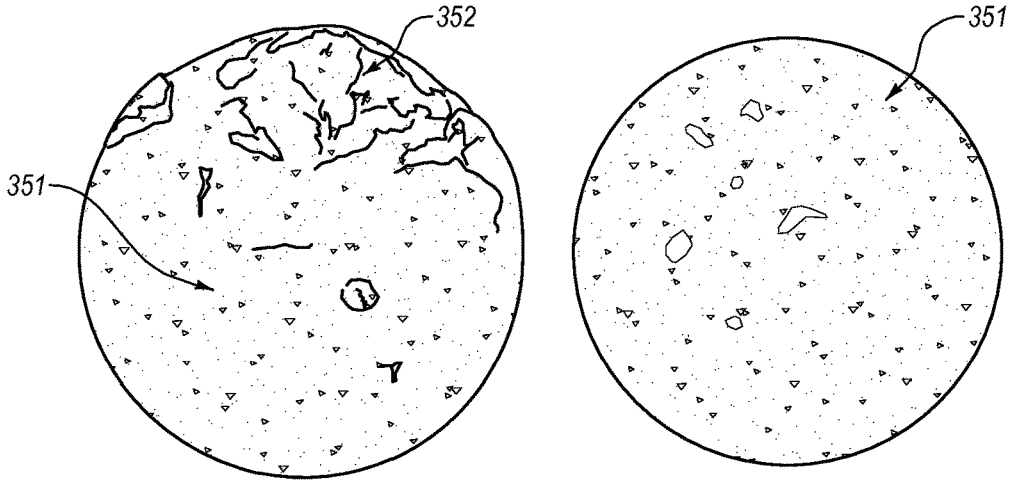
FIGS. 6B and 6C show vertical cross-sections of the binder heads of FIG. 6A (left) and FIG. 6A (right).
Figure 6B:
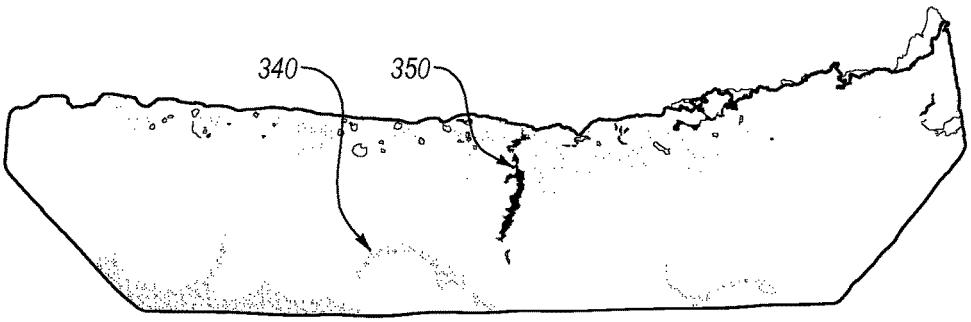
Figure 6C:
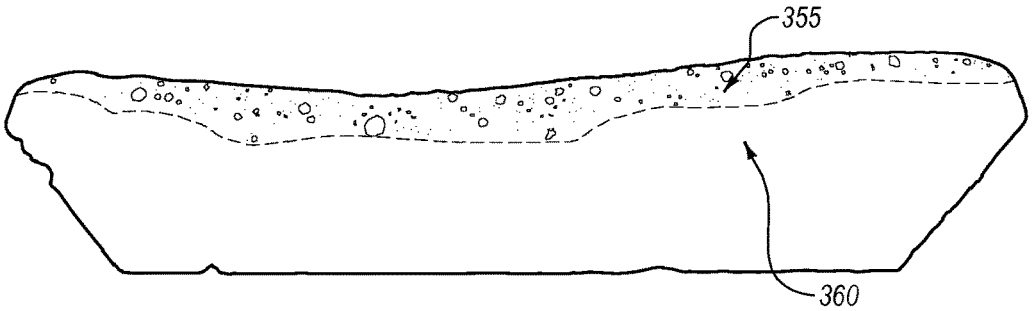

FIGS. 6A to 6C show a comparison of the binder heads of the metal-matrix composites of Examples 4 and 9. FIG. 6A is a top-down view of the binder heads made using a flux-coated binder (right) and a binder head made using a binder having a top-loaded flux powder (left). FIG. 6A serves as a comparison of surface oxides (351) and defects (352) on the respective binder heads of the metal-matrix composites. FIG. 6A shows that the metal-matrix composite of Example 9 (at right), manufactured using flux-coated binder, had less surface oxides and surface defects compared to that of Example 4 (at left), manufactured using a top-loaded flux powder.

FIGS. 6B and 6C show vertical cross-sections of the binder heads of FIG. 6A. FIGS. 6B and 6C serve as a comparison of defects (340, 350, 355) throughout the binder heads of FIG. 6A (i.e., the binder heads of Examples 4 and 9). FIGS. 6B and 6C show that the binder head of Example 9, manufactured using the flux-coated binder, had less defects and a larger defect-free zone (360) as shown in FIG.

6C compared to the binder head of Example 4, manufactured using a top-loaded flux powder as shown in FIG. 6B.

Example 12: Comparison of Pre-Heating Stages for Various Binders

Figure 8:
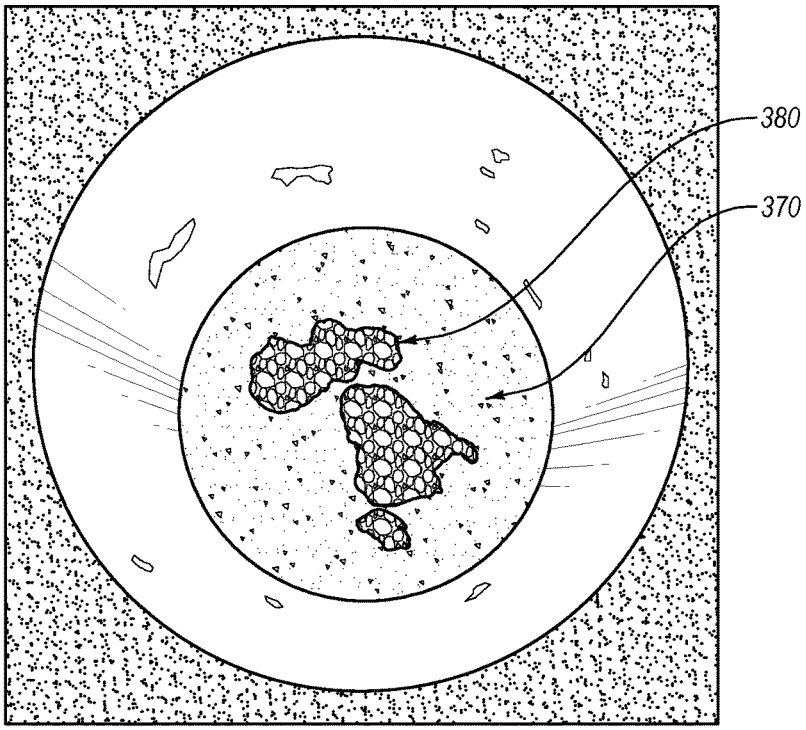
FIGS. 8 and 9 show emptied molds, the molds being emptied after performing a pre-heating stage on a flux-coated binder using brown flux/water as a binding material and a flux-coated binder using Poly-G as the binding material, respectively, contained in the molds.
Figure 9:
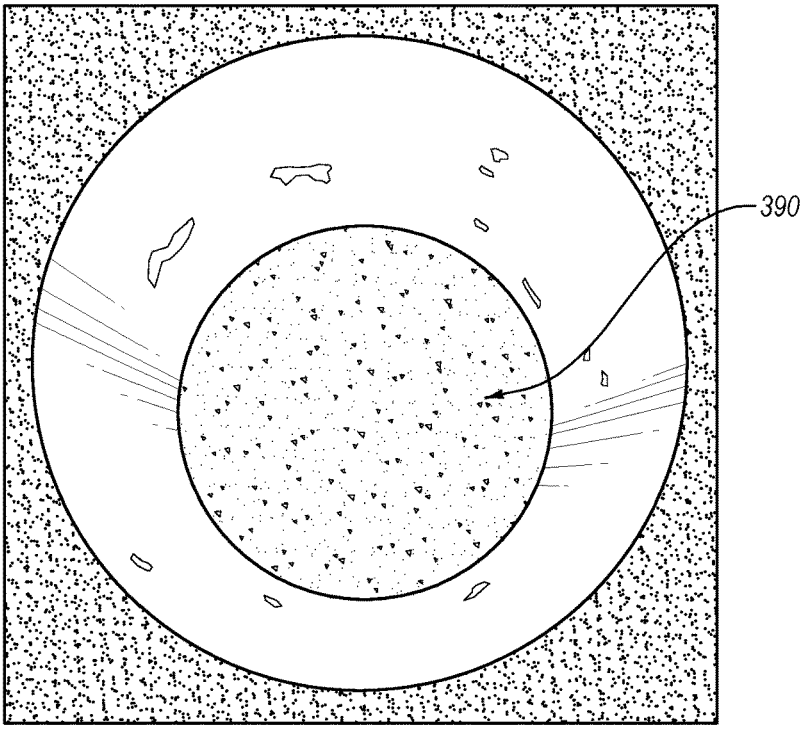

FIGS. 8 and 9 show mold containers after performing a pre-heating stage (1 hour pre-heat at 1000° F.) on two samples of the same binder, each containing a flux-coated binder, and emptying the resulting contents from the mold. In FIG. 8 a brown flux/water mixture was used as a binding material. In FIG. 9 Poly-G mixture was used as the binding material. Both binder were mixed with an adequate amount of H-600 for about 30 seconds. FIG. 8 shows that melted flux (380) traveled to the bottom of the mold container (370) through the spaces between the binder slugs (see e.g., FIG. 1, 55), thus indicating that some excessive flux may still reach the matrix powder in a drill bit body mold and cause bondline defects. FIG. 9 shows no visible flux at the bottom of the mold container (390), thus indicating a more uniform distribution of flux being maintained during preheating. FIG. 9 illustrates that a flux-coated binder using Poly-G as the binding material can further reduce or eliminate bondline defects.

Example 13: Making a Drill Bit Body

Figure 10:
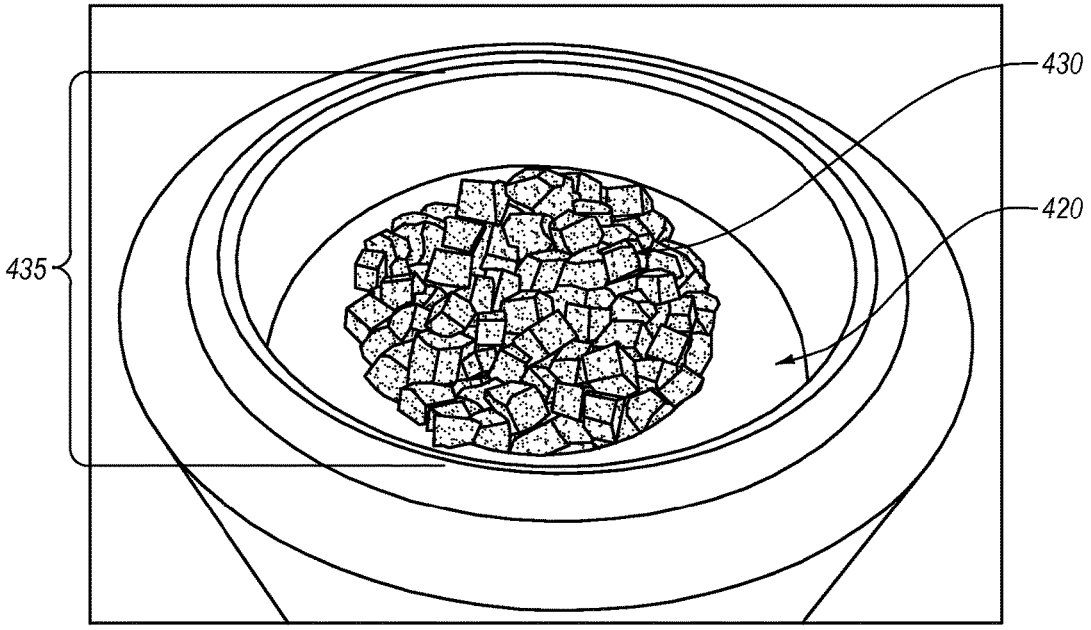
FIG. 10 is a top view of a load assembly for making the metal-matrix composite-based drill bit body with the flux-coated binder loaded into a funnel ring of the mold.
Figure 11:
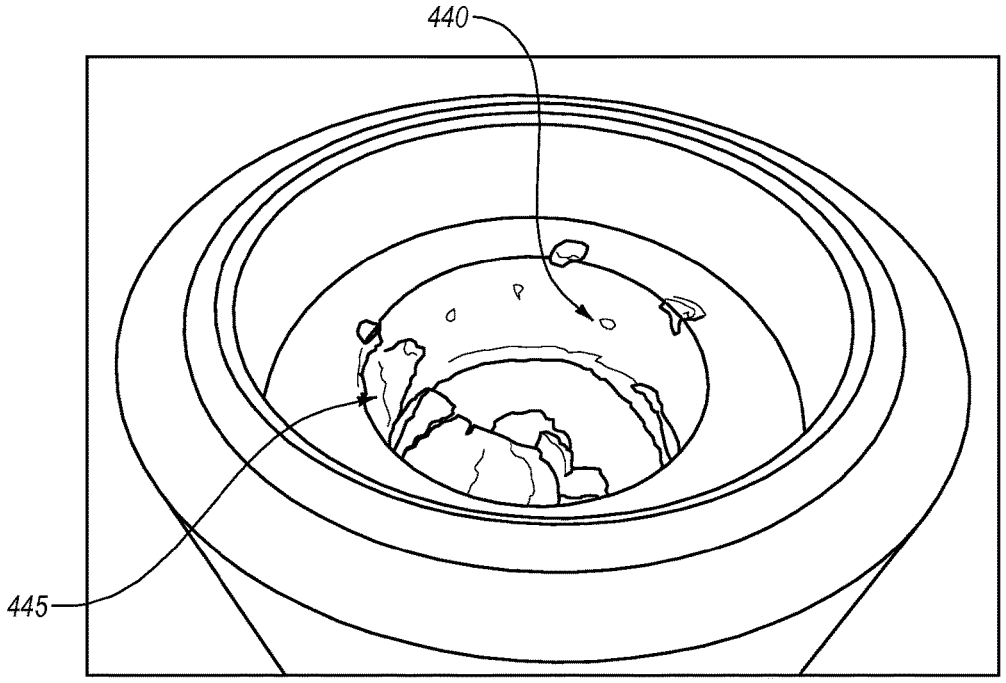
FIG. 11 is a top view of the in-mold metal-matrix composite drill bit body resulting from the load assembly of FIG. 10.

For illustration, the following example is described by referring to the load assembly shown schematically in FIG. 1, the load assembly shown in FIG. 10 and the in-mold drill bit body shown in FIG. 11. Matrix powder (e.g., a matrix powder including cast tungsten carbide with a size of about 100 micrometers and less than about 10 wt % of a nickel powder) (FIG. 1, 30) was loaded into the blade region (FIG. 1, 35) in the base (FIG. 1, 20) of the drill bit body mold (FIG. 1, 10). A second matrix powder (e.g., a matrix powder including a mixture of agglomerate tungsten carbide and cast tungsten carbide having a size of 30 to 150 micrometers and including less than about 10 wt % of a nickel powder) was then loaded into the body (FIG. 1, 65) located in the base (FIG. 1, 20) of the drill bit body mold. A steel blank was added to the drill bit body mold. Subsequent vibration shaking was used to compact the matrix powders. A first funnel ring (bottom funnel) (FIG. 1, 60) was then fitted to the base (FIG. 1, 20) of the mold. A third matrix powder (e.g., a matrix powder including a tungsten (W) powder mixed with less than about 8 wt % Ni) (FIG. 1, 40) was added to the first funnel ring (FIG. 1, 60). The third matrix powder was then compacted by vibration shaking. A flux-coated binder (FIG. 1, 70) (FIG. 10, 430) was then added to the first funnel ring (FIG. 1, 60) (FIG. 10, 420) to form a final load assembly (FIG. 1, 10) (FIG. 10, 435). The load assembly (FIG. 1, 10) (FIG. 10, 435) was heated to about 2200° F. for about 55 minutes and subsequently cooled to form the in-mold drill bit body shown in FIG. 11. The drill bit body was removed from the mold. The resulting out-of-mold drill bit body was finished (e.g., by machining) and/or processed for analysis of its physical properties (e.g., strength, defects, presence of slags).

Example 14: Making a Drill Bit Body

Figure 12:
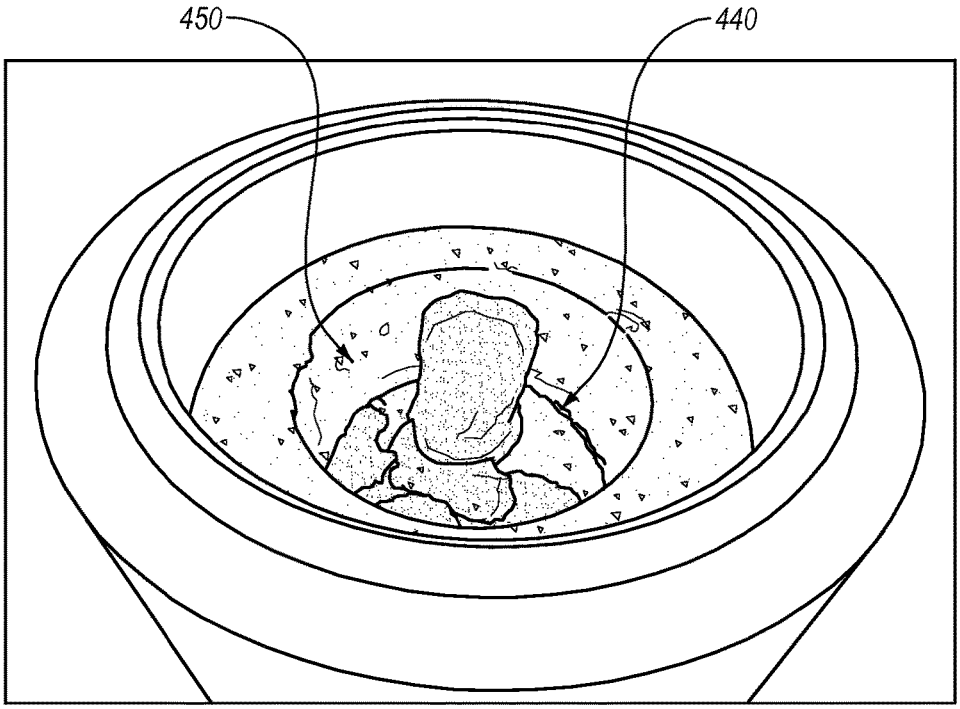
FIG. 12 is a top view of an in-mold metal-matrix composite drill bit body resulting from infiltration of a matrix powder with a binder and a top-loaded flux-powder.

For comparison, a drill bit body was made in the same way as Example 13, except that a binder and a top-loaded flux powder was used instead of a flux-coated binder. FIG. 12 shows the in-mold drill bit body made using the binder with a top-loaded flux powder.

Example 15: Analysis of the Drill Bit Bodies of Examples 13 and 14

Comparison of Surface Oxides and Defects—

FIG. 11 shows the in-mold drill bit body made using the flux-coated binder. FIG. 12 shows the in-mold drill bit body made using the binder with a top-loaded flux powder. FIGS. 11 and 12 serve as a comparison of surface oxides (440, 455) and slags (445, 450) in each respective binder head after solidification. In particular, the in-mold drill bit body shown in FIG. 11 shows less surface oxides and defects compared to the in-mold drill bit body shown in FIG. 12.

Cross-Sectional Analysis of the Matrix/Steel Blank Bond—

Figure 13:
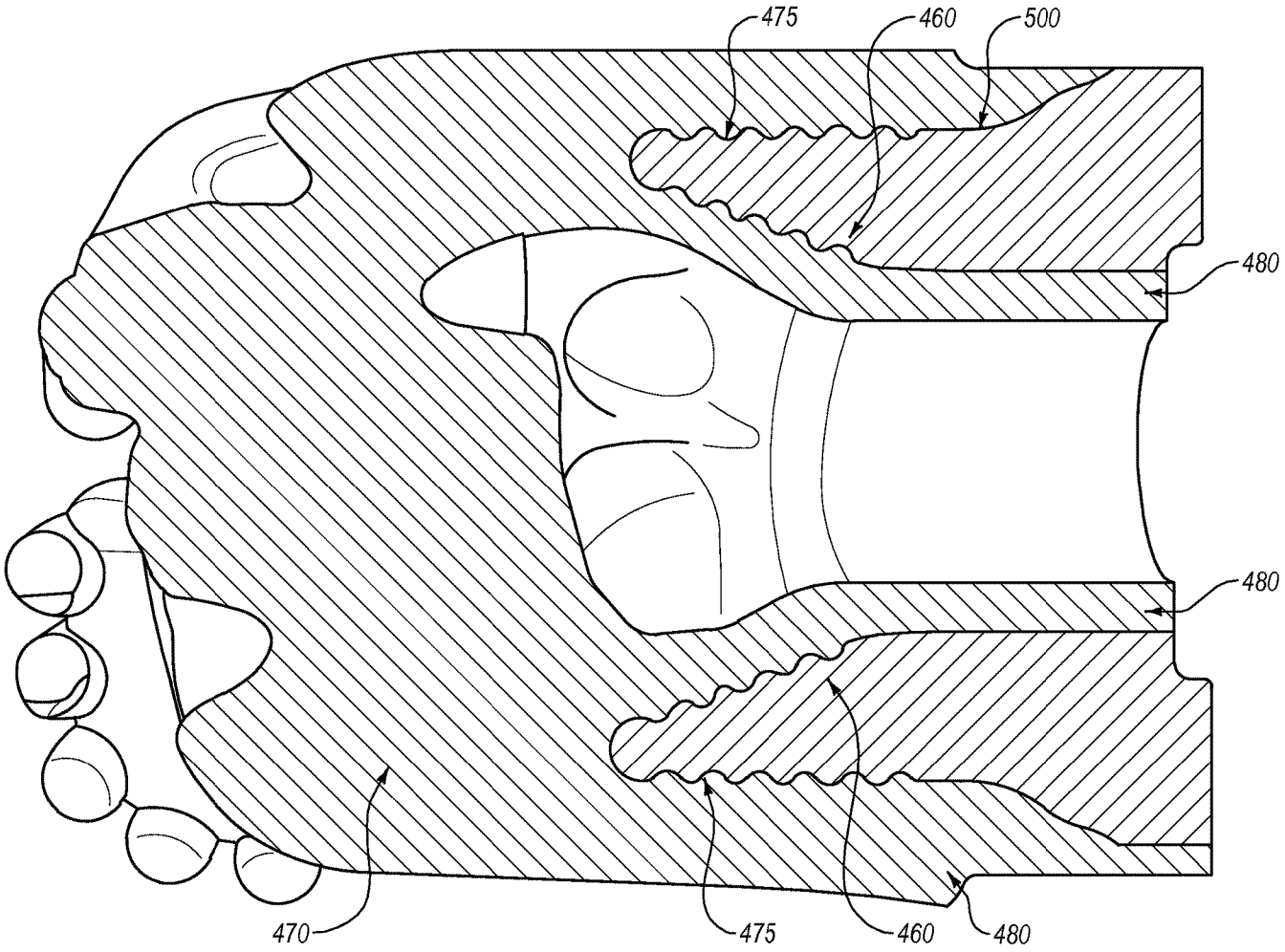
FIG. 13 shows a cross-section of the out-of-mold metal-matrix composite-based drill pictured in-mold in FIG. 11.
Figure 14:
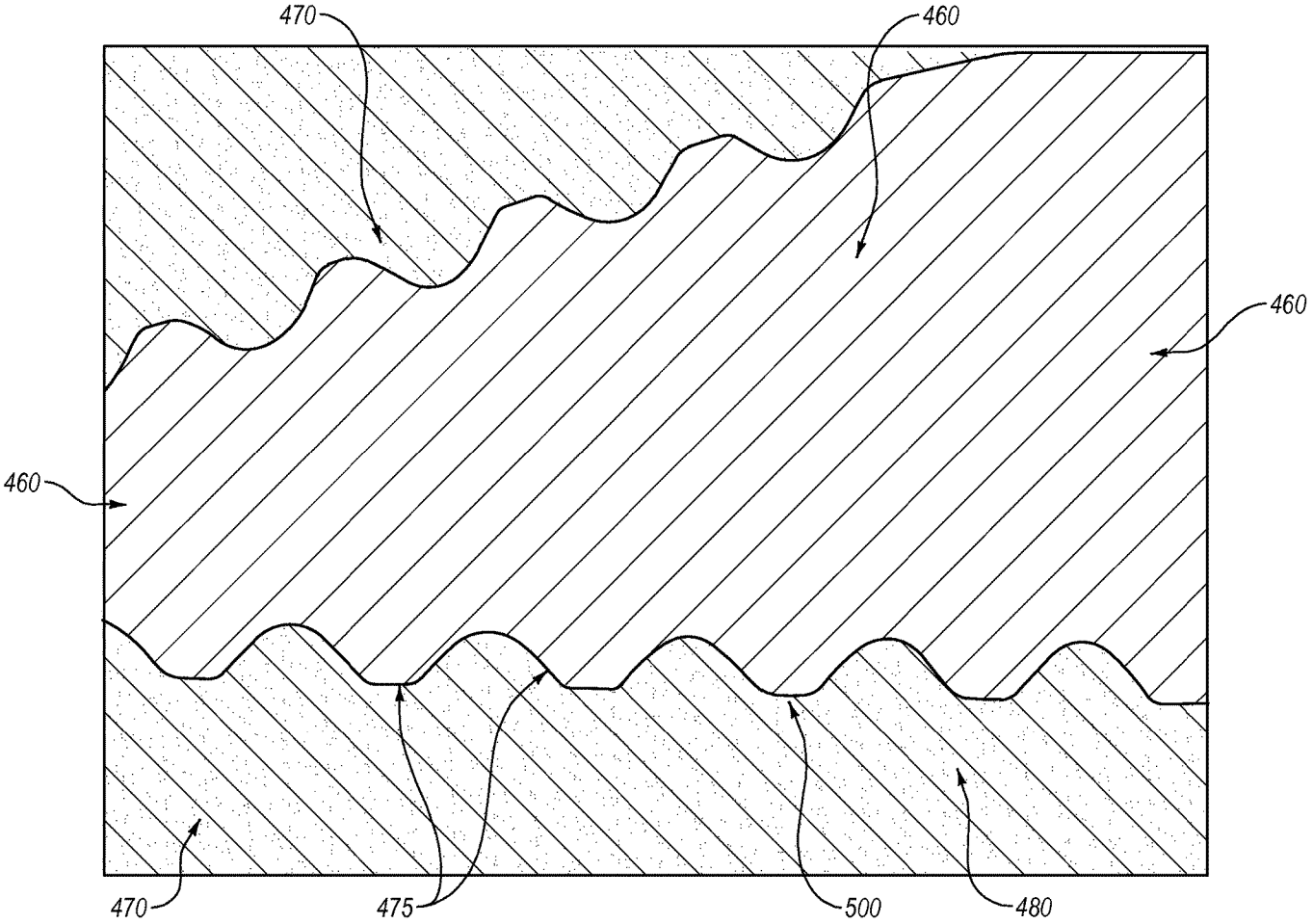
FIG. 14 is a close-up image showing the bonding of the steel blanks to the metal-matrix composite-based drill bit cross-section shown in FIG. 13, after applying a torsional force.

The drill bit body of Example 12 was cut in half along its vertical axis to expose a cross section for further analysis. FIG. 13 shows the bonding of the steel blank (460) with the other regions of the bit body, including bonding at the interface (475) between the steel blank (460) and the first metal-matrix composite region (470); and bonding at the interface (500) between the steel blank (460) and the second metal-matrix composite region (480). FIG. 14 shows a close up view of the steel blank bonding after applying a torque of 60,000 ft.-lbs. It can be seen in FIG. 14 that the matrix-steel blank bond is not affected by this amount of torsional strain.

Comparison of Amount of Binder Used—

An amount of binder used in the manufacturing of a drill bit body may be an important factor in terms of cost. From this perspective, it is desirable to use an amount of binder that is approximately equal to the amount needed for infiltration, and not substantially more, as excess binder may need to be machined off prior to welding the drill bit body to an API connector. In particular, the excess binder having defects may need to be machined off. In the drill bit body of Example 12, 47% less binder was used compared to the amount used in Example 13. This is because Example 13 used a larger amount of binder to account for localized excess flux and slags that form as a result of the non-uniform distribution of flux in the molten binder when the flux is top-loaded onto the binder before heating.

The methods and products described herein may be used in metal-matrix drill bits, as described herein. Such bits may include fixed cutter drill bits, impregnated drill bits, hammer drill bits, roller cone drill bits, or any other type of drill bit. The methods and products described herein may also be used in other downhole tools or components that include metal-matrix composites. In addition, the methods and products described herein may also be used in any situation, product, or component where a binder is used to infiltrate particles to form a matrix.

Although only a few embodiments have been described in detail above, those skilled in the art will readily appreciate that many modifications are possible in the example embodiments without materially departing from this disclosure. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A flux-coated binder, the flux-coated binder comprising:

a metal binder; and a flux powder adhered to a surface of the metal binder, the flux powder being 0.25 to 2.5 wt. % of a total amount of metal binder;

the metal binder having a surface area to volume ratio of 8.6 to 20 square inches per cubic inch.

2. The flux-coated binder according to claim 1, wherein the flux powder adhered to the surface of the metal binder is uniformly distributed about the surface of the metal binder.

3. The flux-coated binder according to claim 1, wherein the flux powder includes a material selected from the group consisting of boric acid, a borate compound, a fluoride, and combinations thereof.

4. The flux-coated binder according to claim 1, wherein the binder comprises a metal selected from the group consisting of copper, aluminum, magnesium, iron-based, cobalt, and an alloy thereof.

5. The flux-coated binder according to claim 1, further comprising a binding material adhered to the surface of the metal binder, wherein the binding material is coated on the metal binder and wherein the flux powder is adhered to the binding material to provide the flux-coated binder.

6. The flux-coated binder according to claim 5, wherein the binding material is a fluid or a gel.

7. The flux-coated binder according to claim 5, wherein the binding material is a polyether polyol.

8. The flux-coated binder according to claim 5, wherein the binding material comprises a rosin a modified rosin, a liquid polyether polyol, or a brown flux.

9. The flux-coated binder according to claim 5, the flux powder being 0.25 to 2.5 wt % of a total amount of metal binder and binding material.

10. The flux-coated binder according to claim 1, the metal binder including a plurality of binder slugs.

11. A flux-coated binder, the flux-coated binder comprising:

a metal binder having a melting temperature greater than 790° C.; and a flux powder adhered to a surface of the metal binder;

the metal binder having a surface area to volume ratio of 8.6 to 20 square inches per cubic inch.

12. The flux-coated binder according to claim 11, wherein the flux powder adhered to the surface of the metal binder is uniformly distributed about the surface of the metal binder.

13. The flux-coated binder according to claim 11, wherein the flux powder includes a material selected from the group consisting of boric acid, a borate compound, a fluoride, and combinations thereof.

14. The flux-coated binder according to claim 11, further comprising a binding material adhered to the surface of the metal binder, wherein the binding material is coated on the metal binder and wherein the flux powder is adhered to the binding material to provide the flux-coated binder.

15. The flux-coated binder according to claim 14, wherein the binding material is a fluid or a gel.

16. The flux-coated binder according to claim 14, wherein the binding material is a polyether polyol.

17. The flux-coated binder according to claim 14, wherein the binding material comprises a rosin a modified rosin, a liquid polyether polyol, or a brown flux.

18. The flux-coated binder according to claim 14, the flux powder being 0.25 to 2.5 wt % of a total amount of metal binder and binding material.

19. The flux-coated binder according to claim 14, the metal binder including a plurality of binder slugs.

* * * * *